US006042657A

United States Patent [19]

Okamura et al.

[11] Patent Number: 6,042,657

[45] **Date of Patent: *Mar. 28, 2000**

[54] REGENERATOR MATERIAL FOR EXTREMELY LOW TEMPERATURES AND REGENERATOR FOR EXTREMELY LOW TEMPERATURES USING THE SAME

[75] Inventors: Masami Okamura; Naoyuki Sori, both of Yokohama, Japan

[73] Assignee: Kabushiki Kaisha Toshiba, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/793,261

[22] PCT Filed: Aug. 22, 1995

[86] PCT No.: PCT/JP95/01653

§ 371 Date: Feb. 21, 1997

§ 102(e) Date: Feb. 21, 1997

[87] PCT Pub. No.: WO96/06315

PCT Pub. Date: Feb. 29, 1996

[30] Foreign Application Priority Data

Aug. 23, 1994 [JP] Japan ..... 6-198347
Dec. 22, 1994 [JP] Japan ..... 6-320366

[51] Int. Cl.[7] ..... H01F 1/055

[52] U.S. Cl. ..... 148/101; 148/301; 148/303; 62/3.1; 62/6

[58] Field of Search ..... 148/301, 302, 148/303, 101; 62/3.1, 6

[56] References Cited

U.S. PATENT DOCUMENTS 5,186,765 2/1993 Arai et al. ..... 148/301

FOREIGN PATENT DOCUMENTS 0 327 293 A2 8/1989 European Pat. Off. .
51-52378 5/1976 Japan .
1-310269 12/1989 Japan .
2-309159 12/1990 Japan .
3-174486 7/1991 Japan .

*Primary Examiner*—John Sheehan
*Attorney, Agent, or Firm*—Finnegan, Henderson, Farabow, Garrett & Dunner, L.L.P.

[57] ABSTRACT

A cold heat accumulating material for extremely low temperatures which comprises cold heat accumulating granular bodies in which a rate of particles, which are destroyed when a compressive force of 5 MPa is applied thereto by a mechanical strength evaluation die, out of the magnetic cold heat accumulating particles constituting the magnetic cold heat accumulating granular bodies is not than 1 wt. %. In this magnetic cold heat accumulating granular bodies, a rate of magnetic cold heat accumulating particles having more than 1.5 form factor R expressed by $L^2/4\pi A$, wherein L represents a circumferential length of a projected image of each magnetic cold heat accumulating particle, and A a real of the projected image, is not more than 5%. Such a cold heat accumulating material for extremely low temperatures is capable of providing excellent mechanical properties with respect to mechanical vibration with a high reproducibility. A cold heat accumulator for extremely low temperatures is formed by filling a cold heat accumulating container with a cold heat accumulating material for extremely low temperatures comprising the above-mentioned magnetic cold heat accumulating granular bodies. Such a cold heat accumulator for extremely low temperatures can display excellent performance for a long period of time.

23 Claims, 3 Drawing Sheets

REGENERATOR MATERIAL FOR EXTREMELY LOW TEMPERATURES AND REGENERATOR FOR EXTREMELY LOW TEMPERATURES USING THE SAME

TECHNICAL FIELD

The present invention relates to a regenerator material for extremely low temperatures for use in refrigerators and such like and a regenerator for extremely low temperatures using the same.

BACKGROUND OF ART

In recent years there have been notable developments in superconducting technology, and along with expansion in relevant fields of application the development of compact and high performance refrigerators has become essential. Such refrigerators demand light weight, compactness and high efficiency.

For instance, refrigerators with freezing cycles such as the Gifford MacMahon system or the Sterling system have been used in superconducting MRI and cryopump and the like. In addition, high performance refrigerators are indispensable for magnetic levitation trains. In such refrigerators, an operating medium such as compressed He gas flows in one direction through a regenerator filled with regenerator material and supplies the resulting thermal energy to the regenerator material, and the expanded operating medium then flows in the opposite direction and receives thermal energy from the regenerator material. In this process, as the regenerative effect is improved, thermal efficiency of the operating medium cycle is increased and it becomes possible to achieve even lower temperatures.

Cu or Pb and the like have conventionally been used as regenerator material in the above-mentioned refrigerators. However, specific heat of such regenerator material becomes noticeably low at extremely low temperatures below 20 K and consequently the above-mentioned regenerative effect does not function sufficiently making it difficult to achieve extremely low temperatures.

Therefore, in order to achieve temperatures closer to absolute zero, the use of magnetic regenerator materials which exhibit substantial specific heat in extremely low temperatures such as Er—Ni type intermetallic compounds such as $Er_3$ Ni, ErNi, $ErNi_2$ (See Japanese Patent Laid-Open Application No. Hei 1-310269) or ARh type intermetallic compounds (A: Sm, Gd, Tb, Dy, Ho, Er, Tm, Yb) (See Japanese Patent Laid-Open Application No. Sho 51-52378) such as ErRh is recently being considered.

However, during operation of the above-mentioned regenerators, the operating medium such as He gas passes at high pressure and high speed through gaps in the regenerator material with which the regenerator is filled and consequently the flow direction of the operating medium changes at frequent intervals. As a result, the regenerator material is subject to a variety of forces such as mechanical vibration. Stress is also applied when filling the regenerator with the material Though the regenerator material is subject to the various forces, magnetic regenerator material of the intermetallic compounds described above such as $Er_3Ni$ or ErRh is generally brittle and consequently is prone to pulverization as a result of mechanical vibration during operation or pressure during filling or such like. The particles generated by this pulverization influence harmfully the performance of the regenerator, such as obstructing the gas seal. Moreover, there is also the problem that the degree of deterioration in the performance of the regenerator when using a magnetic regenerator material of the intermetallic compounds as described above varies widely depending the manufactured batches of magnetic regenerator material and the like.

It is therefore the object of the present invention to provide a regenerator material which have excellent mechanical properties for mechanical vibration and filling stress and such like with a high reproducibility, a regenerator which have excellent refrigerating performance in extremely low temperature over a long period of time with a high reproducibility by using such a regenerator material, and a refrigerator using such a regenerator for extremely low temperatures.

DISCLOSURE OF THE INVENTION

Having considered various means for achieving the objectives described above, the present inventors have discovered that the mechanical strength of magnetic regenerator material particles of intermetallic compounds and such like containing rare earth elements is highly dependent on the precipitation volume, the precipitation situation, the form and such like of rare earth carbides and rare earth oxides, which exist in the grain boundary. The precipitation volume and precipitation situation and such like of these rare earth cabides and rare earth oxides are complexly related to the amount of carbon and oxide impurities, atmosphere in the rapid solidification process, cooling velocity, melt temperature and such like, and therefore they alter greatly depending the manufactured batch of the magnetic regenerator material particles. It was discovered that the mechanical strength of the magnetic regenerator particles therefore varies greatly with each manufactured batch and that it would be extremely difficult to predict mechanical strength from manufacturing conditions and such like alone.

In order to improve the mechanical reliability of magnetic regenerator particles, following detailed consideration of the mechanical properties of magnetic regenerator particles, it was learned that mechanical reliability of magnetic regenerator particles can be estimated by considering the mechanical strength of not an individual magnetic regenerator particle but an aggregation of magnetic regenerator particles, concentration of stress when a force is applied to aggregation of magnetic regenerator particles. With regard to the form of magnetic regenerator particles, it was further discovered that it is possible to increase the mechanical reliability of magnetic regenerator particles by selectively using magnetic regenerator particles with a form having few protrusions. The present invention is based on these new knowledges.

In other words, a first regenerator material for extremely low temperatures of the present invention is characterized in that it comprises aggregation of magnetic regenerator particles, in which a rate of the particles which are fractured is not more than 1 wt. % when a compressive stress of 5 MPa is applied thereto.

A first regenerator for extremely low temperatures of the present invention comprises a regenerator container filled with the above-mentioned first regenerator material for extremely low temperatures.

Furthermore, a second regenerator material for extremely low temperatures of the present invention is characterized in that it comprises aggregation of magnetic regenerator particles, in which a rate of the particles satisfying that form factor R is more than 1.5, wherein R is expressed by $L^2/4\pi A$, L represents a perimeter of a projected image of the individual regenerator particle and A represents an area of the projected image, is not more than 5%.

A second regenerator for extremely low temperatures of the present invention comprises a regenerator container filled with the above-mentioned second regenerator material for extremely low temperatures.

Moreover, a refrigerator of the present invention includes the above-mentioned first regenerator for extremely low temperatures or the second regenerator for extremely low temperatures.

A regenerator material for extremely low temperatures of the present invention consists of magnetic regenerator particles, namely an aggregate of magnetic regenerator particles. For instance, intermetallic compounds including rare earth elements expressed by $RM_Z$ (R represents at least one rare earth element chosen from Y, La, Ce, Pr, Nd, Pm, Sm, Eu, Gd, Tb, Dy, Ho, Er, Tm and Yb; M represents at least one metallic element chosen from Ni, Co, Cu, Ag, Al and Ru; z represents a number between 0.001~9.0) or intermetallic compounds including rare earth elements expressed by ARh (A represents at least one rare earth element chosen from Sm, Gd, Tb, Dy, Ho, Er, Tm and Yb) are appropriate as the magnetic regenerator material in the present invention.

When the magnetic regenerator particles described above have almost spherical form and are uniform in size, they can smooth out the flow of the gas. Consequently, not less than 70 wt. % of the whole magnetic regenerator particles can suitably be constituted with magnetic regenerator particles each having a shape such that the ratio of the major diameter to the minor diameter (aspect ratio) is not greater than 5, and with a diameter of 0.01~3.0 mm.

When the magnetic regenerator particle aspect ratio exceeds 5, it becomes difficult to fill to make gaps uniform. Consequently when such particles exceed 30 wt. % of the whole magnetic regenerator particles, the regenerator performance and the like may deteriorate. The aspect ratio should preferably be not more than 3 and ideally not more than 2. Furthermore, the rate of magnetic regenerator particles with a particle aspect ratio of not more than 5 should preferably be not less than 80 wt. % and ideally not less than 90 wt. %.

Moreover, when the diameter of the magnetic regenerator particles is less than 0.01 mm, the packing density becomes too much, thereby the pressure loss of working medium such as helium is likely to increase. On the other hand, when the particle size of the magnetic regenerator particles is more than 3.0 mm, the area of heat transfer surface between the magnetic regenerator particles and the working medium becomes small, thereby heat transfer efficiency deteriorates. Accordingly, when the percentage of such particles is more than 30% by weight of the magnetic regenerator particles, the regenerator performance etc. is likely to deteriorate. The particle size is preferably in a range of 0.05~2.0 mm, more preferably in a range of 0.1~0.5 mm. The percentage of the particles having a diameter ranging 0.01~3.0 mm in the whole magnetic regenerator particles is preferably not less than 80% by weight, more preferably not less than 90% by weight.

A regenerator material for extremely low temperatures of the present invention comprises magnetic regenerator particles in which the rate of particles which are fractured when a compressive stress of 5 MPa is applied to an aggregate of magnetic regenerator particles with the above-mentioned form is not more than 1 wt. %. As described above, the present invention considers the mechanical strength of an aggregate of magnetic regenerator particles in which the mechanical strength of each regenerator particle for extremely low temperatures is complexly related to the volume of carbon and oxide impurities, atmosphere during the rapid solidification process, cooling velocity, melt temperature and such like, and wherein a complex concentration of stress occurs when stress is applied to an aggregate of these particles. By measuring the rate of particles fractured when a compressive stress of 5 MPa is applied to such aggregates of magnetic regenerator particles, it is possible to evaluate the reliability of the magnetic regenerator particles with respect to mechanical strength.

In other words, when the rate of particles fractured when a compressive stress of 5 MPa is applied to an aggregate of magnetic regenerator particles is not more than 1 wt. %, hardly any magnetic regenerator particles are pulverized as a result of mechanical vibration during an operation of refrigerator or by stress and such like when filling the regenerator container with these particles, even if the manufacturing batches and manufacturing conditions are different. Therefore, the problems such as obstruction of gas seals in refrigerators and the like can be prevented by using magnetic regenerator particles with these mechanical properties. The reliability cannot be evaluated, since most magnetic regenerator particles, irrespective of their internal morphology, are not fractured by the application of a compressive stress of less than 5 MPa.

The above-mentioned reliability evaluation of magnetic regenerator particles is carried out as follows. First, a fixed amount of magnetic regenerator particles is extracted randomly from each manufacturing batch which comply with a specified aspect ratio, particle size and such like. Second, as FIG. 1 shows, the extracted magnetic regenerator particles 1 are filled within a die 2 for the mechanical strength evaluation and a stress of 5 MPa is applied thereto. The stress needs to be increased gradually; for instance, crosshead speed in these tests is roughly 0.1 mm/min. Furthermore, the die 2 material is die steel and such like. After stress has been applied, fractured magnetic regenerator particles are sorted by sieving and shape separation, and the reliability of the aggregate of magnetic regenerator particles is evaluated by measuring the weight of the fractured particles. An extraction of around 1 g of magnetic regenerator particles from each manufacturing batch is sufficient.

The rate of particles fractured when a compressive stress of 5 MPa is applied to magnetic regenerator particles should preferably be not more than 0.1 wt. % and ideally not more than 0.01 wt. %. In addition, for a reliability evaluation of magnetic regenerator particles, the rate of particles fractured when a compressive stress of 10 MPa is applied thereto should preferably be not more than 1 wt. % and should ideally satisfy the same conditions when a compressive stress of 20 MPa is applied.

A regenerator material for extremely low temperatures of the present invention can basically prevent the generation of pulverization of particles by satisfying the above-mentioned mechanical strength of aggregates of magnetic regenerator particles when a compressive stress is applied thereto, and mechanical reliability can be further improved in order to be capable of preventing more effectively the chipping and such like by the use of magnetic regenerator particles with a form as described below.

In other words, regenerator particles should preferably have a spherical form as explained above and when this form is more precisely spherical and the size of the particles is more uniform, the flow of the gas can be smoothed out and extreme stress concentration occurring when a compressive stress is applied to these particles can be restricted. Mechanical vibration during refrigerator operation or stress applied when the regenerator is filled with regenerator material are conceivable as the above-mentioned compressive stress. The stress is most likely to concentrate when particles with a less spherical form are subjected to a compressive stress.

Conventionally, only the ratio of the major diameter to the minor diameter (i.e. the aspect ratio) has been used when evaluating the spherical form of magnetic regenerator particles (for instance, see Japanese Patent Laid-Open Application No. Hei 3-174486). However, the aspect ratio tends to be a lower value when the roundness of an ellipse is evaluated although it is valid as a parameter for evaluating the whole particle form, even if there are protrusions on the particle surface for example these protrusions have little influence on the aspect ratio.

When the magnetic regenerator particles used as regenerator material for extremely low temperatures comprise particles with complex surface forms such as protrusions, stress concentrate on the protrusions and such like when a compressive stress is applied, and the mechanical strength of the magnetic regenerator particles is thereby adversely affected. Therefore in the present invention, a rate of regenerator particles satisfying that form factor R is greater than 1.5, wherein R is expressed by $L^2/4\pi A$, L represents a perimeter of a projected image of the individual magnetic regenerator particles and A represents an area of the projected image, is preferably not more than 5%.

As FIG. 2 shows, when protrusions are present on the particle surface, even a particle with a highly spherical form will have a high form factor R value (high partial shape irregularity). Furthermore, as FIG. 3 shows, a particle with a comparatively smooth surface will have a low form factor R value even if its form is rather unspherical. In contrast, the aspect ratio described above tends to be a lower value for particles such as that shown in FIG. 3 (aspect ratio=b/a) and a higher value for particles with surface protrusions and the like such as shown in FIG. 2.

In other words, a low form factor R indicates that the particle surface is comparatively smooth (low partial shape irregularity) and R is an effective parameter for evaluating partial form irregularity of particles. Therefore, by using particles with a low form factor R it is possible to achieve improvements in the mechanical strength of magnetic regenerator particles. In fact, even particles whose aspect ratio exceeds 5 do not adversely affect the mechanical strength of magnetic regenerator particles substantially provided that the particle surface is smooth. On the other hand, when particles with the projections and such like have high partial form irregularity and their form factor R exceeds 1.5, the projections are liable to chip and consequently such particles have poor mechanical strength. Therefore, when the rate of such particles with high partial form irregularity exceeds 5%, the mechanical strength of the magnetic regenerator particles is adversely affected.

Based on the reasons described above, the rate of particles with a form factor R exceeding 1.5 should preferably not be more than 5%, more preferably not more than 2% and ideally not more than 1%. Furthermore, the rate of particles with a form factor R exceeding 1.3 should preferably not be more than 15%, more preferably not more than 10% and ideally not more than 5%. However, since the aspect ratio is important for evaluating the degree of sphericity, having satisfied form factor R provisions, not less than 70 wt. % of the magnetic regenerator particles should preferably have an aspect ratio of not more than 5 as described above.

The manufacturing method of magnetic regenerator particles described above is by no means restricted and a variety of manufacturing methods can be employed. For instance, melt of a designated composition can be rapidly solidified using methods such as centrifugal atomization, gas atomization and rotational electrode method. In addition, magnetic regenerator particles in which a rate of particles satisfying that form factor R is greater than 1.5 is not more than 5%, can be obtained by for instance optimizing manufacturing conditions and carrying out shape separation such as inclined vibrating plate method.

A regenerator for extremely low temperatures of the present invention uses magnetic regenerator particles having mechanical properties as described above, namely magnetic regenerator particles with a rate of particles fractured when a compressive stress of 5 MPa is applied of not more than 1 wt. %. Moreover a regenerator for extremely low temperatures of the present invention can be composed of magnetic regenerator particles with a rate of particles satisfying that form factor R is greater than 1.5 of not more than 5%. A regenerator for extremely low temperatures wherein a regenerator has been filled with magnetic regenerator particles satisfying both mechanical properties and form is especially preferable.

Since magnetic regenerator particles used in a regenerator for extremely low temperatures of the present invention contain hardly any magnetic regenerator particles which are pulverized as a result of mechanical vibration during a refrigerator operation or compressive stress when filling the container of a regenerator, and such like, obstruction of gas seals in refrigerators and such like can be prevented. Therefore, a regenerator for extremely low temperatures capable of steadily maintaining refrigerating performance over a long period of time and moreover a refrigerator capable of steadily maintaining refrigerating performance over a long period of time can be obtained with high reproducibility.

MODE FOR EMBODYING THE INVENTION

The preferred embodiments of the present invention will next be explained.

Embodiment 1

First, an $Er_3$ Ni mother alloy was prepared by high frequency fusion. This $Er_3$ Ni mother alloy was melted at approximately 1373 K and the melt thereby obtained was poured onto a rotating disc in Ar atmosphere (pressure= approximately 101 kPa) and rapidly solidified. The particles obtained were sieved and classified according to form and 1 kg of spherical particles with diameters of between 0.2~0.3 mm was selected. Particles with an aspect ratio of not more than 5 constituted not less than 90 wt. % of all the particles in these particles. This process was carried out repeatedly and 10 batches of spherical $Er_3$ Ni particles were obtained.

Figure 1:
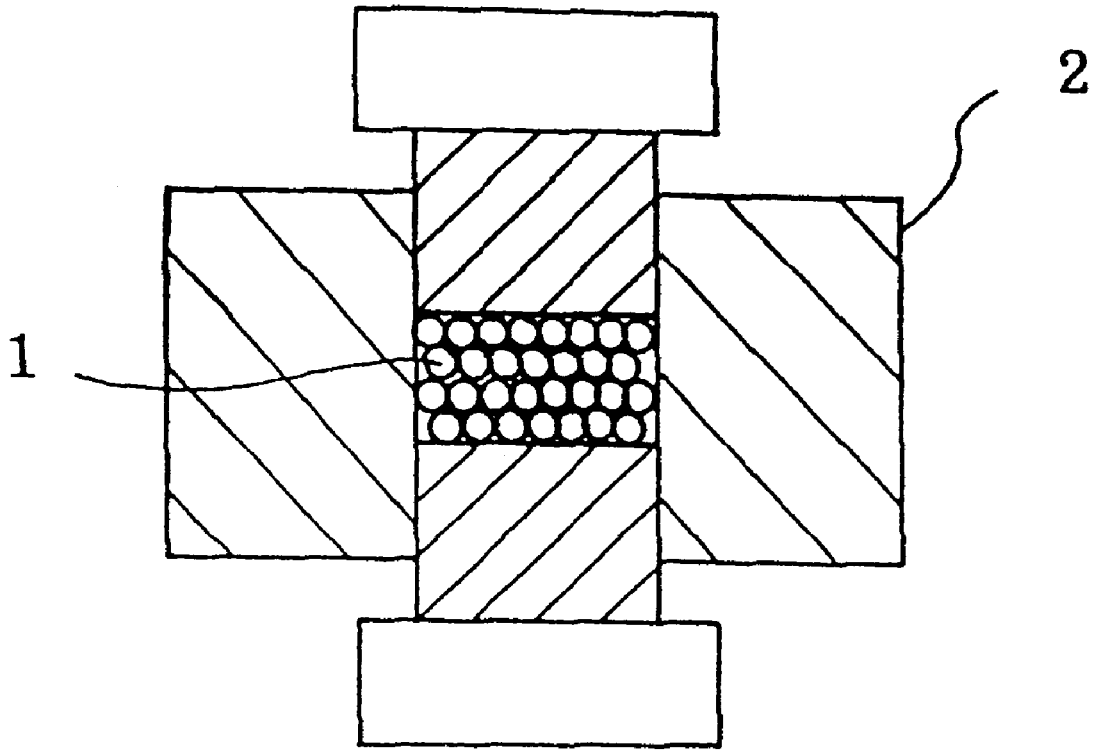
FIG. 1 is a cross-sectional drawing depicting an example of a die used for mechanical strength evaluation in order to evaluate the reliability of magnetic regenerator particles of the present invention.
Figure 2:
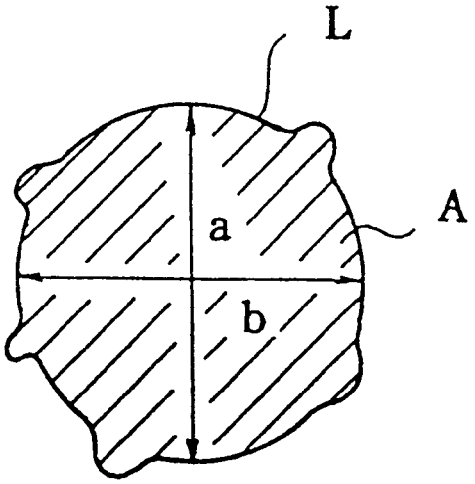
FIG. 2 is a schematic drawing showing a relation between an example form of a magnetic regenerator particle and a parameter to evaluate degree of sphericity.
Figure 3:
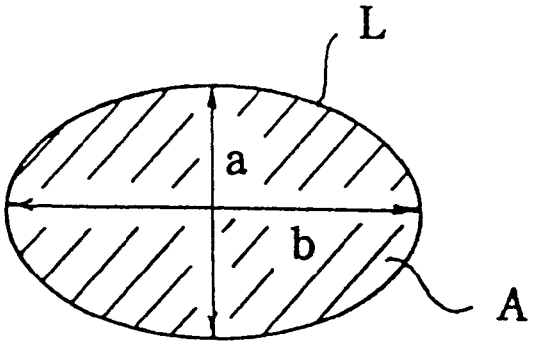
FIG. 3 is a schematic drawing showing a relation between another example form of a magnetic regenerator particle and a parameter to evaluate degree of sphericity.

Next, 1 g of particles was randomly extracted from each of the ten batches of spherical $Er_3$ Ni particles. These extracted particles were each filled within a die 2 for mechanical strength evaluation shown in FIG. 1 and a compressive stress of 5 MPa (crosshead speed=0.1 mm/min) was applied using an Instron-type testing machine. Following the test, all particles were sieved and classified according to form and the weight of the fractured spherical $Er_3$ Ni particles was measured. The batch in which the fractured particle rate was 0.004 wt. % was selected as magnetic regenerator particles for this embodiment. When the form factor R of these magnetic regenerator particles in this batch was evaluated by image analysis, the rate of particles having a form factor R of more than 1.5 was not more than 5%.

Magnetic regenerator spherical particles comprising $Er_3$ Ni selected in the manner described above were filled in a regenerator container at a packing factor of 70% to construct a regenerator for extremely low temperatures. A two-stage GM refrigerator, which is shown schematically in FIG. 4, was constructed using this regenerator for extremely low temperatures and refrigerator testing was carried out. Test results showed an initial refrigeration capacity of 320 mW was obtained at 4.2 K and stable refrigeration capacity was obtained throughout 5000 hours of continuous operation.

Figure 4:
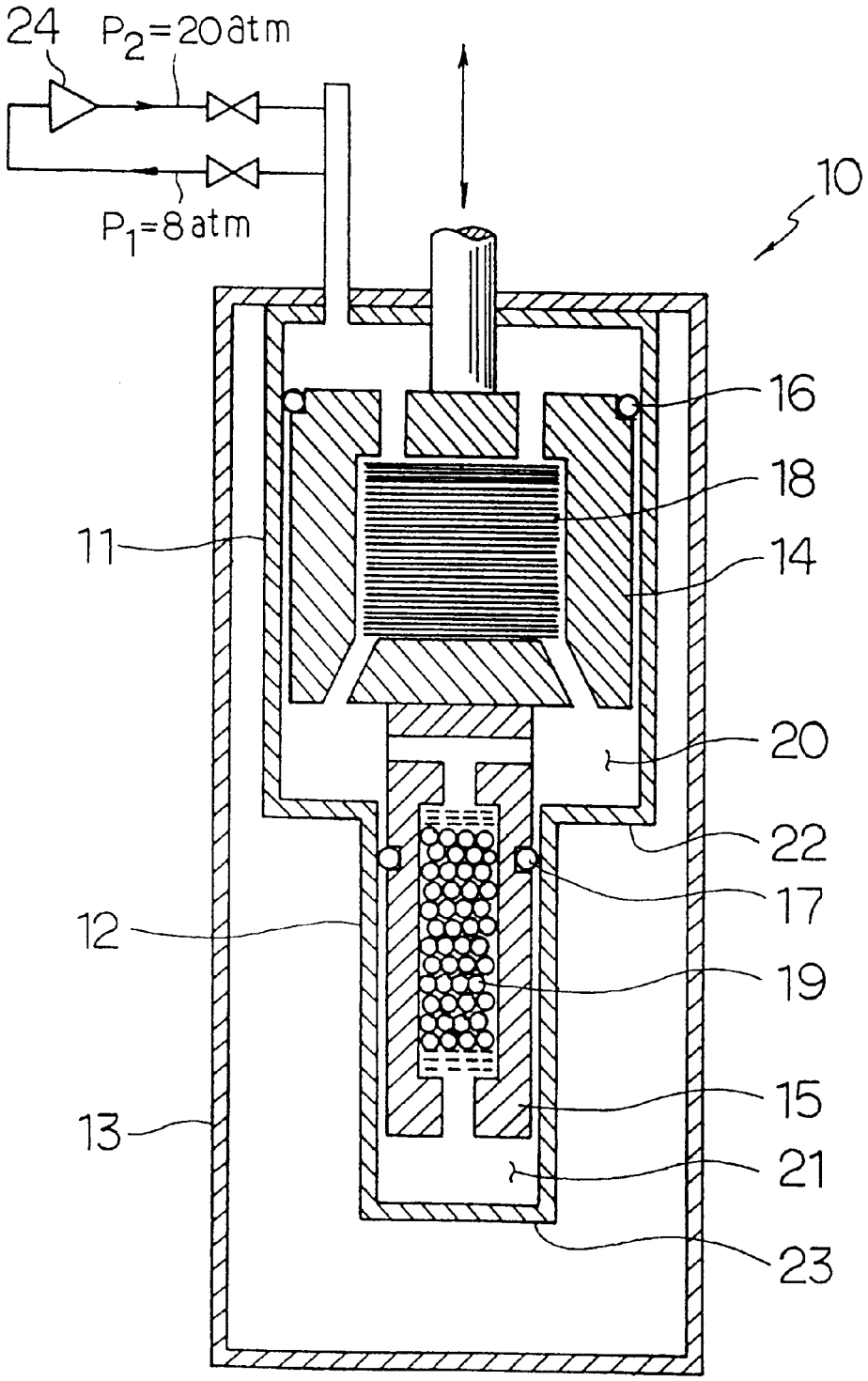
FIG. 4 is a drawing depicting a configuration of a GM refrigerator manufactured in an embodiment of the present invention.

The two-stage GM refrigerator 10 shown in FIG. 4 has a vacuum chamber 13 provided with a large-diameter first cylinder 11 and a small-diameter second cylinder 12 which is cocentrically connected thereto. A first regenerator 14 can reciprocate in the first cylinder 11 and a second regenerator 15 can reciprocate in the second cylinder 12. Seal rings 16 and 17 are provided respectively between the first cylinder 11 and the first regenerator 14 and between the second cylinder 12 and the second regenerator 15.

The first regenerator 14 contains a first regenerator material 18 such as Cu mesh. The second regenerator 15 is configured according to a regenerator for extremely low temperatures of the present invention and contains a regenerator material for extremely low temperatures 19 of the present invention as a second regenerator material. The first regenerator 14 and the second regenerator 15 have passages for an operating medium such as He gas provided in the gaps and such like of the first regenerator material 18 and the regenerator material for extremely low temperatures 19 respectively.

A first expansion space 20 is provided between the first regenerator 14 and the second regenerator 15. A second expansion space 21 is provided between the second regenerator 15 and the cold stage of the second cylinder 12. A first cooling stage 22 is formed in the lower portion of the first expansion space 20 and a second cooling stage 23 at a lower temperature than the first cooling stage 22 is formed in the lower portion of the second expansion space 21.

A compressor 24 supplies a high pressure operating medium (e.g. He gas) to the above-mentioned two-stage GM refrigerator 10. The supplied operating medium passes through the first regenerator material 18 contained in the first regenerator 14 and reaches the first expansion space 20, then passes through the regenerator material for extremely low temperatures 19 (the second regenerator material) contained in the second regenerator 15 and reaches the second expansion space 21. In this process, the operating medium cools by supplying thermal energy to both regenerator materials 18 and 19. Having passed through regenerator materials 18 and 19 the operating medium expands and absorbs heat in the first and second expansion space 20, 21 and both cooling stages 22 and 23 are cooled. The expanded operating medium now flows in reverse direction through both regenerator materials 18 and 19. After receiving thermal energy from the regenerator materials 18 and 19, the operating medium is exhaused. This process increases the cooling efficiency of the operating medium cycle and achieves even lower temperatures, as the regenerator efficiency improves.

Embodiment 2

As in the embodiment 1, 10 batches were produced of spherical $Er_3Ni$ particles with particle diameters of between 0.2~0.3 mm of which particles with an aspect ratio of not more than 5 constituted not less than 90 wt. %. Next, 1 g of particles was randomly extracted from each of the ten batches of spherical $Er_3Ni$ particles. These extracted particles were each filled within the die 2 for mechanical strength evaluation shown in FIG. 1 and a compressive stress of 5 MPa (crosshead speed=0.1 mm/min) was applied thereto using an Instron-type testing machine. Following the test, all the particles were sieved and classified according to form and the weight of the fractured spherical $Er_3Ni$ particles was measured. The rate of fractured particles is shown in Table 1.

The magnetic regenerator spherical particles consisting of $Er_3Ni$ from each of the 10 batches were respectively filled in regenerator containers at a packing factor of 70% and then put in a two-stage GM refrigerator and refrigerating testing was carried out as in the embodiment 1. The test results are also shown in Table 1.

COMPARATIVE EXAMPLE 1

A batch in which the rate of spherical $Er_3Ni$ particles fractured when a compressive stress of 5 MPa was applied thereto was 1.3 wt. % was selected from the 10 batches of spherical $Er_3Ni$ particles produced in the embodiment 1. The selected magnetic regenerator spherical particles of $Er_3Ni$ were filled in a regenerator at a packing factor of 70%, respectively, and then put in a two-stage GM refrigerator and refrigerating testing was carried out as in the embodiment 1. The test results are shown in Table 1.

TABLE 1

| Test No. | Rate of particles fractured by compressive stress test of 5 MPa (wt. %) | Refrigeration capacity (mW) Initial Value | After 5000 hours |
|---|---|---|---|
| | Embodiment 2 | | |
| 1 | 0.001 | 321 | 320 |
| 2 | 0.007 | 325 | 325 |
| 3 | 0.840 | 327 | 305 |
| 4 | 0.014 | 326 | 321 |
| 5 | 0.001 | 322 | 320 |
| 6 | 0.110 | 325 | 318 |
| 7 | 0.021 | 329 | 326 |
| 8 | 0.008 | 330 | 328 |
| 9 | 0.045 | 324 | 320 |
| 10 | 0.216 | 321 | 314 |
| Comparative Example 1 | 1.3 | 320 | 270 |

As Table 1 clearly shows, all the regenerators using magnetic regenerator particles in which the rate of particles fractured when a compressive stress of 5 MPa was applied was not more than 1 wt. % maintained excellent refrigeration capacity over a long period of time.

COMPARATIVE EXAMPLE 2

As in the embodiment 1, 10 batches were produced of spherical $Er_3Ni$ particles with diameters of between 0.2~0.3 mm of which particles with an aspect ratio of not more than 5 constituted not less than 90 wt. %. Next, 1 g of particles was randomly extracted from each of the ten batches of spherical $Er_3Ni$ particles. These extracted particles were each filled within the die 2 for the mechanical strength evaluation shown in FIG. 1 and a compressive stress of 3 MPa (crosshead speed=0.1 mm/min) was applied using an Instron-type testing machine, but hardly any particles were fractured. Since hardly any particles are fractured by a compressive stress of less than 5 MPa, reliability cannot be evaluated.

EMBODIMENT 3

First, an $Er_3Co$ mother alloy was prepared by high frequency fusion. This $Er_3Co$ mother alloy was melted at approximately 1373 K and the melt thereby obtained was poured onto a rotating disc in Ar atmosphere (pressure=approximately 101 kPa) and rapidly solidified. The particles obtained were sieved and classified according to form and 1 kg of spherical particles with diameters of between 200~300 μm was selected. Particles with an aspect ratio of not more than 5 constituted not less than 90 wt. % of all the particles. This process was carried out repeatedly and 10 batches of spherical $Er_3Co$ particles were obtained.

Next, 1 g of particles was randomly extracted from each of the above-mentioned 10 batches of spherical $Er_3Co$ particles. These extracted particles were each filled within a die 2 for mechanical strength evaluation shown in FIG. 1 and a compressive stress of 5 MPa (crosshead speed=0.1 mm/min) was applied thereto using an Instron-type testing machine. Following the test, all particles were sieved and classified according to form and the weight of the fractured spherical $Er_3Co$ particles was measured. The rates of particles fractured are shown in Table 2. When the form factor R of each of these magnetic regenerator particles was evaluated by image analysis, all rates of particles in which R was more than 1.5 were not more than 5%.

The above-mentioned magnetic regenerator spherical particles of $Er_3Co$ were filled in a regenerator at a packing factor of 70%, respectively, put in a two-stage GM refrigerator identical to that in the embodiment 1 and refrigerator testing was carried out. Test results are also shown in Table 2.

TABLE 2

| Test No. | Rate of particles fractured by compressive stress test of 5 MPa (wt. %) | refrigeration capacity (mW) Initial Value | refrigeration capacity (mW) After 5000 hours |
|---|---|---|---|
| | Embodiment 3 | | |
| 1 | 0.002 | 306 | 305 |
| 2 | 0.003 | 309 | 308 |
| 3 | 0.109 | 302 | 297 |
| 4 | 0.021 | 305 | 302 |
| 5 | 0.007 | 308 | 308 |
| 6 | 0.030 | 302 | 299 |
| 7 | 0.004 | 306 | 304 |
| 8 | 0.005 | 300 | 298 |
| 9 | 0.043 | 306 | 303 |
| 10 | 0.007 | 309 | 309 |

As Table 2 clearly shows, all the regenerators using magnetic regenerator particles in which the rate of particles fractured when a compressive stress of 5 MPa was applied was not more than 1 wt. % maintained excellent refrigeration capacity over a long period of time.

Furthermore, it was confirmed from this embodiment 3 and from embodiments 1 and 2 described above that irrespective of the composition and such like of the magnetic regenerator material, when magnetic regenerator particles in which the rate of particles fractured when a compressive stress of 5 MPa was applied was not more than 1 wt. % are used, excellent refrigerating capability can be maintained over a long period of time.

EMBODIMENT 4, COMPARATIVE EXAMPLE 3

An ErAg mother alloy was prepared by high frequency fusion. This ErAg mother alloy was melted at approximately 1573 K and the melt thereby obtained was poured onto a rotating disc in Ar atmosphere (pressure=approximately 101 kPa) and rapidly solidified. The particles obtained were sieved and classified according to form and 1 kg of spherical particles with diameters of between 0.2~0.3 mm was selected. Particles with an aspect ratio of not more than 5 constituted not less than 90 wt. % of all the particles. This process was carried out repeatedly and 5 batches of spherical ErAg particles were obtained.

Next, 1 g of particles was randomly extracted from each of the above-mentioned 5 batches of spherical ErAg particles. These extracted particles were each filled within a die 2 for mechanical strength evaluation shown in FIG. 1 and a compressive stress of 5 MPa (crosshead speed=0.1 mm/ml) was applied using an Instron-type testing machine. Following the test, all particles were sieved and classified according to form and the weight of the fractured spherical ErAg particles was measured. The rates of particles fractured are shown in Table 3.

The above-mentioned magnetic regenerator spherical particles of ErAg were filled in regenerator at a packing factor of 64%. These regenerators were then put in a two-stagte GM refrigerator as a second regenerator respectively and refrigerator testing was carried out to measure the lowest temperatures attained by the refrigerators. Initial values of lowest temperatures attained and lowest temperatures achieved after 5000 hours of continuous operation are shown respectively in Table 3.

TABLE 3

| Test No. | Rate of particles fractured by compressive stress test of 5 MPa (wt. %) | Lowest Temperature Attained (K) Initial Value | Lowest Temperature Attained (K) After 5000 hours |
|---|---|---|---|
| | Embodiment 4 | | |
| 1 | 0.031 | 6.3 | 7.6 |
| 2 | 0.003 | 6.7 | 7.4 |
| 3 | 0.107 | 6.6 | 8.3 |
| | Comparative Example 3 | | |
| 4 | 1.259 | 6.7 | 15.4 |
| 5 | 2.117 | 6.5 | 23.8 |

EMBODIMENT 5, COMPARATIVE EXAMPLE 4

First, an ErNi mother alloy was prepared by high frequency fusion. This ErNi mother alloy was melted at approximately 1473 K and the melt thereby obtained was poured onto a rotating disc in Ar atmosphere (pressure=approximately 101 kPa) and rapidly solidified. The particles obtained were sieved and classified according to form and 1 kg of spherical particles with diameters of between 0.25~0.35 mm was selected. Particles with an aspect ratio of not more than 5 constituted not less than 90 wt. % of all the particles. This process was carried out repeatedly and 5 batches of spherical ErNi particles were produced. In addition, 5 batches of spherical $Ho_2Al$ particles were produced.

Next, 1 g of particles was randomly extracted from each of the above-mentioned 5 batches of spherical ErNi particles and the 5 batches of spherical $Ho_2Al$ particles. The extracted particles were each filled within a die 2 for mechanical strength evaluation shown in FIG. 1 and a compressive stress of 5 MPa (crosshead speed=0.1 mm/min) was applied thereto using an Instron-type testing machine. Following the test, all particles were sieved and classified according to form and the weight of the fractured particles was measured. The rates of particles fructured are shown in Table 4.

The magnetic regenerator spherical particles of ErNi and $Ho_2Al$ were filled in regenerator in a 2-layered structure in which ErNi particles occupied the lower temperature half side and $Ho_2Al$ particles occupied in the higher temperature half side at a packing factor of 64%, respectively. Each of these regenerators was then put in a two-stage GM refrigerator as second regenerators and refrigerator testing was carried out to measure the lowest temperatures attained by the refrigerator. Initial values of lowest temperatures attained and lowest temperatures achieved after 5000 hours of continuous operation are shown respectively in Table 4.

TABLE 4

| Test No. | | Rate of particles fractured by compressive stress test of 5 MPa (wt. %) | Lowest Temperature Attained (k) Initial Value | After 5000 hours |
|---|---|---|---|---|
| | | Embodiment 5 | | |
| 1 | ErAg | 0.003 | 3.4 | 3.7 |
| | $Ho_2Al$ | 0.005 | | |
| 2 | ErAg | 0.005 | 3.6 | 4.1 |
| | $Ho_2Al$ | 0.048 | | |
| 3 | ErAg | 0.016 | 3.4 | 3.9 |
| | $Ho_2Al$ | 0.009 | | |
| | | Comparative Example 4 | | |
| 4 | ErAg | 1.600 | 3.7 | 7.3 |
| | $Ho_2Al$ | 1.233 | | |
| 5 | ErAg | 1.706 | 3.9 | 8.3 |
| | $Ho_2Al$ | 1.727 | | |

EMBODIMENT 6, COMPARATIVE EXAMPLE 5

An $HoCu_2$ mother alloy was prepared by high frequency fusion. This $HoCu_2$ mother alloy was melted at approximately 1373 K and the melt thereby obtained was poured onto a rotating disc in Ar atmosphere (pressure= approximately 101 kpa) and rapidly solidified. The particles obtained were sieved to adjust diameters 0.2~0.3 mm, shape separation was carried out using an inclined vibrating plate method and 1 kg of spherical particles was selected. Particles with an aspect ratio of not more than 5 constituted not less than 90 wt. % of all the particles. This process was carried out repeatedly and 5 batches of spherical $HoCu_2$ particles were produced. The roundness of each batch of spherical $HoCu_2$ particles was then altered by adjusting shape separation conditions such as for instance an angle of inclination and vibration power.

The perimeter of a projected image L and the area of the projected image A of each particle of the 5 batches of spherical $HoCu_2$ particles obtained were measured by image analysis and a form factor R expressed by $L^2/4\pi A$ was evaluated. Results are shown in Table 5.

In addition, 1 g of particles was randomly extracted from each of the above-mentioned 5 batches of spherical $HoCu_2$ particles. These extracted particles were each filled within a die 2 for mechanical strength evaluation shown in FIG. 1 and a compressive stress of 5 MPa (crosshead speed=0.1 mm/min) was applied thereto using an Instron-type testing machine. Following the test, all particles were sieved and classified according to form and the weight of the fractured spherical $HoCu_2$ particles was measured. The rates of particles fractured are shown in Table 5.

The magnetic regenerator spherical particles of $HoCu_2$ were filled in regenerator, respectively, at a packing factor of 64%. These regenerators were then put respectively in two-stage GM refrigerators as second regenerator and refrigerator testing was carried out to measure the lowest temperatures attained by the refrigerators. Initial values of lowest temperatures attained and lowest temperatures achieved after 5000 hours of continuous operation are also shown respectively in Table 5.

TABLE 5

| Test No. | Rate of particles each of which R is more than 1.5 (%) | Rate of particles fractured by compressive stress test of 5 MPa (wt. %) | Lowest Temperature Attained (K.) Initial Value | After 5000 hours |
|---|---|---|---|---|
| | | Embodiment 6 | | |
| 1 | 0.6 | 0.012 | 5.1 | 5.6 |
| 2 | 1.5 | 0.007 | 5.3 | 5.9 |
| 3 | 6.6 | 0.040 | 5.5 | 6.6 |
| 4 | 5.6 | 0.307 | 6.7 | 8.2 |
| | | Comparative Example 5 | | |
| 5 | 7.9 | 1.474 | 6.5 | 13.8 |

EMBODIMENT 7

First, an $Er_3Ni$ mother alloy was prepared by high frequency fusion. This $Er_3Ni$ mother alloy was melted at approximately 1373 K and the melt thereby obtained was poured onto a rotating disc in Ar atmosphere (pressure= approximately 101 kPa) and rapidly solidified. The particles obtained were sieved and particles with diameters of 0.2~0.3 mm were obtained. Furthermore, shape separation using inclined vibrating plate method was carried out to the particles thereby obtained, to remove particles with high partial irregularity and to select $Er_3Ni$ spherical particles with low partial irregularity.

The perimeter of a projected image L and the area of the projected image A of each particle of obtained the $Er_3Ni$ spherical particles were measured by image analysis and a form factor R expressed by $L^2/4\pi A$ was evaluated. The result showed that the rate of particles with a form factor R more than 1.5 was 0.6% and that the rate of particles with a form factor R more than 1.3 was 4.7%. The aspect ratio for all particles was not more than 5.

Magnetic regenerator spherical particles of $Er_3Ni$ selected by the method described above were filled in a regenerator at a packing factor of 70%. This regenerator was then put in a two-stage GM refrigerator and refrigerator testing was carried out. As a result, an initial refrigeration capacity of 320 mW was obtained at 4.2 K and stable refrigeration capacity was obtained over 5000 hours of continuous operation.

EMBODIMENT 8

An $Er_3Ni$ mother alloy was prepared by high frequency fusion. This $Er_3Ni$ mother alloy was melted at approximately 1300 K and the melt thereby obtained was poured onto a rotating disc in Ar atmosphere (pressure= approximately 30 kPa) and rapidly solidified. The particles obtained were sieved and particles with diameters of 0.2~0.3 mm were obtained. Furthermore, shape separation using inclined vibrating plate method as in the embodiment 7 was carried out to the particles thereby obtained, to remove particles with high partial irregularity and to select $Er_3Ni$ spherical particles with low partial irregularity.

The perimeter of a projected image L and the area of the projected image A of each particle of the $Er_3Ni$ spherical particles obtained were measured by image analysis and a form factor R expressed by $L^2/4\pi A$ was evaluated. The result showed that the rate of particles with a form factor R more than 1.5 was 4% and the rate of particles with a form factor R more than 1.3 was 13%. However, particles with an aspect ratio more than 5 constituted 32 wt. % of all particles.

Magnetic regenerator spherical particles of $Er_3Ni$ selected by the method described above were filled in a regenerator at a packing factor of 70%, placed in a two-stage GM refrigerator and refrigerator testing was carried out. As a result, an initial refrigeration capacity of 310 mW was obtained at 4.2 K and refrigeration capacity after 5000 hours of continuous operation was 305 mW.

COMPARATIVE EXAMPLE 6

Shape separation of particles produced and sieved as in the embodiment 7 was carried out using a inclined vibrating plate with a comparatively smaller angle of inclination than in the embodiment 7 and $Er_3Ni$ spherical particles were selected. When the aspect ratio of the $Er_3Ni$ spherical particles obtained was measured, the aspect ratio of all particles was not more than 5. Furthermore, evaluation of the form factor R of the $Er_3Ni$ spherical particles as in the embodiment 7 revealed that the rate of particles with a form factor R more than 1.5 was 7% and the rate of particles with a form factor R more than 1.3 was 24%.

The above-mentioned $Er_3Ni$ spherical particles were filled in a regenerator at a packing factor of 70%, placed in a two-stage GM refrigerator and refrigerator testing was carried out. The result was that an initial refrigeration capacity of 320 mW was obtained at 4.2 K but after 5000 hours of continuous operation refrigeration capacity had deteriorated to 280 mW.

COMPARATIVE EXAMPLE 7

An $Er_3Ni$ mother alloy was prepared by high frequency fusion. This $Er_3Ni$ mother alloy was melted at approximately 1273 K and the melt thereby obtained was poured onto a rotating disc in Ar atmosphere (pressure= approximately 101 kPa) and rapidly solidificated. The particles obtained were sieved and particles with diameters of 0.2~0.3 mm were obtained. Furthermore, shape separation using inclined vibrating plate method as in the Comparative Example 6 was carried out to the particles obtained and spherical particles were selected.

When the aspect ratio of the $Er_3Ni$ spherical particles obtained was measured, particles with an aspect ratio more than 5 constituted 34 wt. % of all particles. In addition, when the form factor R of the $Er_3Ni$ spherical particles was evaluated by the same method as in the embodiment 7, the rate of particles with a form factor R more than 1.5 was 11% and the rate of particles with a form factor R more than 1.3 was 27%.

The above-mentioned $Er_3Ni$ spherical particles were filled in a regenerator at a packing factor of 70%, placed in a two-stage GM refrigerator and refrigerator testing was carried out. The result was that an initial refrigeration capacity of 320 mW was obtained at 4.2 K but after 5000 hours of continuous operation refrigeration capacity had deteriorated to 270 mW.

EMBODIMENT 9

An $Er_3Co$ mother alloy was prepared by high frequency fusion. This $Er_3Co$ mother alloy was melted at approximately 1373 K and the melt thereby obtained was poured onto a rotating disc in Ar atmosphere (pressure= approximately 101 kPa) and rapidly solidificated. The particles obtained were sieved and particles with diameters of 0.2~0.3 mm were obtained. Furthermore, shape separation using inclined vibrating plate method was carried out to the particles obtained, to remove particles with high partial irregularity and to select $Er_3Co$ spherical particles with low partial irregularity.

The perimeter of a projected image L and the area of the projected image A of each particle of the $Er_3Co$ spherical particles obtained were measured by image analysis and a form factor R expressed by $L^2/4\pi A$ was evaluated. The result showed that the rate of particles with a form factor R more than 1.5 was 0.2% and the rate of particles with a form factor R more than 1.3 was 3.3%. Furthermore, the aspect ratio of all particles was not more than 5.

Magnetic regenerator spherical particles of $Er_3Co$ selected by the method described above were filled in a regenerator at a packing factor of 70%, placed in a two-stage GM refrigerator and refrigerating testing was carried out. As a result, an initial refrigeration capacity of 250 mW was obtained at 4.2 K and stable refrigeration capacfity was obtained over 5000 hours of continuous operation.

INDUSTRIAL APPLICABILITY

As the above embodiments clearly show, according to a regenerator material for extremely low temperatures of the present invention, excellent mechanical properties for mechanical vibration can be obtained with a high reproducibility. Therefore, a regenerator for extremely low temperatures of the present invention using such regenerator material is capable of maintaining excellent refrigerating performance for a long period of time with a high reproducibility.

What is claimed is:

1. A regenerator material for extremely low temperatures comprising:

magnetic regenerator particles, wherein when a compressive stress of 5 MPa is applied to the magnetic regenerator particles, the magnetic regenerator particles comprise 1 wt. % or less of fractured magnetic regenerator particles.

2. A regenerator material for extremely low temperatures according to claim 1, wherein:

5% or less of the magnetic regenerator particles have a form factor R of more than 1.5, wherein R is expressed by $L^2/4\pi A$, wherein L represents a perimeter of a projected image of each magnetic regenerator particle and A represents an area of the projected image.

3. A regenerator material for extremely low temperatures according to claim 1, wherein:

70 wt. % or more of the magnetic regenerator particles have a ratio of the major diameter to the minor diameter equal to or less than 5.

4. A regenerator material for extremely low temperatures according to claim 1, wherein:

70 wt. % or more of the magnetic regenerator particles have a diameter D satisfying the expression $0.01 \leqq D \leqq 3.0$ mm.

5. A regenerator material for extremely low temperatures according to claim 1 wherein:

the magnetic regenerator particles consist of intermetallic compounds including rare earth elements expressed by $RM_z$, wherein R represents at least one rare earth element selected from the group consisting of Y, La, Ce, Pr, Nd, Pm, Sm, Eu, Gd, Tb, Dy, Ho, Er, Tm and Yb; M represents at least one metallic element selected from the group consisting of Ni, Co, Cu, Ag, Al and Ru; and z represents a number satisfying the expression $0.001 \leqq z \leqq 9.0$ or intermetallic compounds including rare earth elements expressed by ARh, wherein A represents at least one rare earth element selected from the group consisting of Sm, Gd, Tb, Dy, Ho, Er, Tm and Yb.

6. A regenerator material for extremely low temperatures comprising:

magnetic regenerator particles, wherein,

5% or less of the magnetic regenerator particles have a form factor R of more than 1.5, wherein R is expressed by $L^2/4\pi A$, wherein L represents a perimeter of a projected image of each magnetic regenerator particle and A represents an area of the projected image.

7. A regenerator material for extremely low temperatures according to claim 6, wherein, in the magnetic regenerator particles, 70 wt. % or more of the magnetic regenerator particles have a ratio of the major diameter to the minor diameter equal to or less than 5.

8. A regenerator material for extremely low temperatures according to claim 6, wherein:

70 wt. % or more of the magnetic regenerator particles have a diameter D satisfying the expression $0.01 \leqq D \leqq 3.0$ mm.

9. A regenerator material for extremely low temperatures according to claim 6, wherein:

the magnetic regenerator particles consist of intermetallic compounds including rare earth elements expressed by $RM_z$, wherein R represents at least one rare earth element selected from the group consisting of Y, La, Ce, Pr, Nd, Pm, Sm, Eu, Gd, Tb, Dy, Ho, Er, Tm and Yb; M represents at least one metallic element selected from the group consisting of Ni, Co, Cu, Ag, Al and Ru; and z represents a number satisfying the expression $0.001 \leqq z \leqq 9.0$ or intermetallic compounds including rare earth elements expressed by ARh, wherein A represents at least one rare earth element selected from the group consisting of Sm, Gd, Tb, Dy, Ho, Er, Tm and Yb.

10. A regenerator for extremely low temperatures comprising:

a regenerator container; and regenerator material for extremely low temperatures, the regenerator material comprising magnetic regenerator particles, which fill inside the regenerator container and when a compressive stress of 5 MPa is applied to the magnetic regenerator particles, the magnetic regenerator particles comprise 1 wt. % or less of fractured magnetic regenerator particles.

11. A regenerator for extremely low temperatures according to claim 10, wherein:

5% or less of the magnetic regenerator particles have a form factor R of more than 1.5, wherein R is expressed by $L^2/4\pi A$, wherein L represents a perimeter of a projected image of each magnetic regenerator particle and A represents an area of the projected image.

12. A regenerator for extremely low temperatures according to claim 10, wherein:

70 wt. % or more of the magnetic regenerator particles have a ratio of the major diameter to the minor diameter equal to or less than 5.

13. A regenerator for extremely low temperatures according to claim 10, wherein:

70 wt. % or more of the magnetic regenerator particles have a diameter D satisfying the expression $0.01 \leqq D \leqq 3.0$ mm.

14. A regenerator for extremely low temperatures according to claim 10, wherein:

the magnetic regenerator particles consist of intermetallic compounds including rare earth elements expressed by $RM_z$, wherein R represents at least one rare earth element selected from the group consisting of Y, La, Ce, Pr, Nd, Pm, Sm, Eu, Gd, Tb, Dy, Ho, Er, Tm and Yb; M represents at least one metallic element selected from the group consisting of Ni, Co, Cu, Ag, Al and Ru; and z represents a number satisfying the expression $0.001 \leqq z \leqq 9.0$ or intermetallic compounds including rare earth elements express by ARh, wherein A represents at least one rare earth element selected from the group consisting of Sm, Gd, Tb, Dy, Ho, Er, Tm and Yb.

15. A regenerator for extremely low temperatures comprising:

a regenerator container; and regenerator material for extremely low temperatures consisting of magnetic regenerator particles filled inside the regenerator container, in which 5% or less of the magnetic regenerator particles have a form factor R of more than 1.5, wherein R is expressed by $L^2/4\pi A$, wherein L represents a perimeter of a projected image of each magnetic regenerator particle and A represents an area of the projected image.

16. A regenerator for extremely low temperatures according to claim 15, wherein:

70 wt. % or more of the magnetic regenerator particles have a ratio of the major diameter to the minor diameter equal to or less than 5.

17. A regenerator for extremely low temperatures according to claim 15 wherein:

70 wt. % or more of the magnetic regenerator particles have a diameter D satisfying the expression $0.01 \leqq D \leqq 3.0$ mm.

18. A regenerator for extremely low temperatures according to claim 15, wherein:

the magnetic regenerator particles consist of intermetallic compounds including rare earth elements expressed by $RM_z$, wherein R represents at least one rare earth element selected from the group consisting of Y, La, Ce, Pr, Nd, Pm, Sm, Eu, Gd, Tb, Dy, Ho, Er, Tm and Yb; M represents at least one metallic element selected from the group consisting of Ni, Co, Cu, Ag, Al and Ru; and z represents a number satisfying the expression $0.001 \leqq z \leqq 9.0$ or intermetallic compounds including rare earth elements expressed by ARh, wherein A represents at least one rare earth element selected from the group consisting of Sm, Gd, Tb, Dy, Ho, Er, Tm and Yb.

19. A refrigerator comprising a regenerator for extremely low temperatures according to claim 10.

20. A refrigerator comprising a regenerator for extremely low temperatures according to claim 15.

21. A manufacturing method of a regenerator material for extremely low temperatures comprising the steps of:

providing magnetic regenerator particles, and testing the particles by applying a compressive stress of 5 MPa to a representative sample of the particles, selecting the magnetic particles in which the representative sample of magnetic regenerator particles comprise 1 wt % or less of fractured particles.

22. A manufacturing method of a regenerator material for extremely low temperatures comprising the steps of:

providing magnetic regenerator particles;

testing the magnetic regenerator particles by applying a compressive stress of 5 MPa to a representative sample of particles extracted from the magnetic regenerator particles, and selecting the magnetic regenerator particles in which the extracted sample of magnetic regenerator particles comprise 1 wt % or less of fractured particles.

23. A manufacturing method of a regenerator material for extremely low temperatures comprising:

providing a plurality of batches of magnetic regenerator particles; and testing each batch of magnetic regenerator particles by applying a compressive stress of 5 MPa to a representative sample of particles extracted from each batch, and selecting the batches in which the representative sample particles of each batch comprises 1 wt % or less of fractured particles.

* * * * *

UNITED STATES PATENT AND TRADEMARK OFFICE

CERTIFICATE OF CORRECTION

PATENT NO. : 6,042,657

DATED : March 28, 2000

INVENTOR(S) : Okamura, et al.

It is certified that error appears in the above-identified patent and that said Letters Patent is hereby corrected as shown below:

Please delete the as-printed Abstract, and replace with the following:

--A regenerator material for extremely low temperatures which comprises magnetic regenerator particles in which a rate of particles, which are fractured when a compressive stress of 5 Mpa is applied thereto using a die for mechanical strength evaluation, is not more than 1 wt.%. In this magnetic regenerator particles, a rate of magnetic regenerator particles having more than 1.5 form factor R expressed by $L^2/4\pi A$, wherein L represents a perimeter of a projected image of each magnetic regenerator particle, and a represents an area of the projected image, is not more than 5%. Such a regenerator material for extremely low temperatures is capable of providing excellent mechanical properties for mechanical vibration with a high reproducibility. A regenerator for extremely low

UNITED STATES PATENT AND TRADEMARK OFFICE

CERTIFICATE OF CORRECTION

PATENT NO. : 6,042,657

DATED : March 28, 2000

INVENTOR(S) : Okamura, et al.

It is certified that error appears in the above-identified patent and that said Letters Patent is hereby corrected as shown below:

temperatures is formed by filling a regenerator container with a regenerator material for extremely low temperatures comprising the above-mentioned magnetic regenerator particles. Such a regenerator for extremely low temperatures can show excellent refrigerating performance for a long period of time.--

Signed and Sealed this

Third Day of April, 2001

*Attest:*

Nicholas P. Godici

NICHOLAS P. GODICI

*Attesting Officer*

*Acting Director of the United States Patent and Trademark Office*